US009960537B2

(12) United States Patent
Tyler

(10) Patent No.: US 9,960,537 B2
(45) Date of Patent: May 1, 2018

(54) CONNECTOR ASSEMBLY WITH SHIPPING CAP

(71) Applicant: TYCO ELECTRONICS CORPORATION, Berwyn, PA (US)

(72) Inventor: Adam Price Tyler, Rochester Hills, MI (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 24 days.

(21) Appl. No.: 15/278,403

(22) Filed: Sep. 28, 2016

(65) Prior Publication Data

US 2018/0090881 A1 Mar. 29, 2018

(51) Int. Cl.

*H01R 13/629* (2006.01)
*H01R 13/639* (2006.01)
*H01R 13/52* (2006.01)

(52) U.S. Cl.

CPC ... *H01R 13/62938* (2013.01); *H01R 13/5213* (2013.01); *H01R 13/62922* (2013.01); *H01R 13/639* (2013.01)

(58) Field of Classification Search

CPC ..... H01R 13/60; H01R 13/447; H01R 13/62933; H01R 13/62938; H01R 13/62955; H01R 13/5213; H01R 4/22

USPC ..... 439/521, 372, 135, 136, 892, 901, 157

See application file for complete search history.

(56) References Cited

U.S. PATENT DOCUMENTS 5,709,561 A * 1/1998 Cadoret ..... H01R 13/62933 439/144
6,739,889 B1 * 5/2004 Daggett ..... H01R 13/62938 439/157
7,377,796 B2 * 5/2008 Matsumura ..... H01R 13/5213 439/157
2004/0074745 A1 * 4/2004 Castaldo ..... H01R 13/701 200/50.28

(Continued)

FOREIGN PATENT DOCUMENTS

DE 102010061384 A1 7/2011
DE 102011004347 A1 8/2012

(Continued)

OTHER PUBLICATIONS

International Search Report, International Application No. PCT/IB2017/055912, dated Sep. 27, 2017.

*Primary Examiner* — Tulsidas C Patel
*Assistant Examiner* — Marcus Harcum

(57) ABSTRACT

A connector assembly includes an electrical connector and a shipping cap. The electrical connector includes a housing and a lever pivotably coupled to the housing. The lever is pivotable relative to the housing between an open position and a closed position. The lever has a guideway configured to receive a guide journal of a mating connector that mates to the electrical connector. The shipping cap is removably mounted to a mating end of the housing when the electrical connector is not mated to the mating connector. The shipping cap includes a lid that covers a mating opening of the housing. The shipping cap further includes a blocking tab that is received in the guideway of the lever when the lever is in the open position. The blocking tab in the guideway engages the lever to block the lever from pivoting to the closed position.

20 Claims, 8 Drawing Sheets

(56) References Cited

U.S. PATENT DOCUMENTS

| | | | | |
|---|---|---|---|---|
| 2014/0131356 | A1* | 5/2014 | Hachadorian ..... | H01R 13/447<br>220/242 |
| 2014/0206211 | A1* | 7/2014 | Coughlan ..... | H01R 13/447<br>439/142 |

FOREIGN PATENT DOCUMENTS

| | | | |
|---|---|---|---|
| EP | 1796223 | A1 | 6/2007 |
| FR | 2733635 | A1 | 10/1996 |

* cited by examiner

CONNECTOR ASSEMBLY WITH SHIPPING CAP

BACKGROUND OF THE INVENTION

The subject matter herein relates generally to electrical connectors and shipping caps that fit on the electrical connectors when the connectors are not mated to mating connectors.

Some known electrical connectors are mounted to one or more wires or cables, referred to herein as a wire harness. Such electrical connectors may be configured to mate with another cable-mounted mating connector or a header mating connector that is secured on a structure of a device. The electrical connectors may include a lever that is used to provide a mating assist. For example, the lever hooks onto a portion of the mating connector such that rotation of the lever pulls the electrical connector closer to the mating connector and secures the two connectors in a mated position. Depending on the application, the electrical connectors may be required to be routed through or another one or more objects in order to reach the mating connector to provide an electrically conductive signal path across the two connectors.

However, installing known electrical connectors that include levers is not without disadvantages. For example, there is a risk that dirt, dust, liquids, and other contaminants and debris may enter an opening in the connector as the connector is routed. Furthermore, routing the electrical connector through small openings and around various objects, such as in an automobile, may cause the lever to become dislodged from a desired position. For example, the lever may need to be at a specific position relative to a housing of the electrical connector in order to properly interlock with the mating connector, and the lever may get bumped out of position during the routing and installation process. Once the electrical connector reaches the mating connector, a worker may be required to reset the position of the lever, remove any cover that protects the connector from contaminants and debris, connect the two connectors, and then rotate the lever to secure the two connectors in the mated position. A need remains for improving the efficiency of routing an electrical connector having a lever through a congested environment and connecting the connector to a mating connector.

BRIEF DESCRIPTION OF THE INVENTION

In an embodiment, a connector assembly is provided that includes an electrical connector and a shipping cap. The electrical connector includes a housing and a lever pivotably coupled to the housing. The housing has a mating opening at a mating end of the housing. The lever is pivotable relative to the housing between an open position and a closed position. The lever has a guideway configured to receive a guide journal of a mating connector that mates to the electrical connector. The shipping cap is removably mounted to the mating end of the housing when the electrical connector is not mated to the mating connector. The shipping cap includes a lid that covers the mating opening of the housing. The shipping cap further includes a blocking tab that is received in the guideway of the lever when the lever is in the open position. The blocking tab in the guideway engages the lever to block the lever from pivoting to the closed position.

In another embodiment, a connector assembly is provided that includes an electrical connector and a shipping cap. The electrical connector includes a housing and a lever pivotably coupled to the housing. The housing extends between a front end and a rear end. The housing has a mating opening configured to receive a mating connector therein. The lever is pivotable relative to the housing between an open position and a closed position. The lever defines a guideway configured to receive a guide journal of the mating connector. The shipping cap is removably mounted to the housing at the front end when the electrical connector is not mated to the mating connector. The shipping cap includes a lid that covers the mating opening of the housing and a shield that extends from the lid along the front end to shield the lever. The shipping cap further includes a blocking tab that is received in the guideway of the lever when the lever is in the open position. The blocking tab in the guideway engages the lever to block the lever from pivoting to the closed position.

In yet another embodiment, a connector assembly is provided that includes an electrical connector and a shipping cap. The electrical connector includes a housing and a lever pivotably coupled to the housing. The housing has a mating opening at a mating end of the housing. The lever is pivotable relative to the housing between an open position and a closed position. The lever has a guideway including a curved cam slot defined by first and second runners that extend a length of the cam slot. The cam slot is configured to receive a guide journal of a mating connector that mates to the electrical connector. The shipping cap is removably mounted to the mating end of the housing when the electrical connector is not mated to the mating connector. The shipping cap includes a lid that covers the mating opening of the housing. The shipping cap further includes a lug that is received in the cam slot of the lever when the lever is in the open position. The lug in the cam slot abuts against at least one of the first and second runners to retain the lever in a partially closed position relative to the housing when the shipping cap is mounted to the housing.

DETAILED DESCRIPTION OF THE INVENTION

Figure 1:
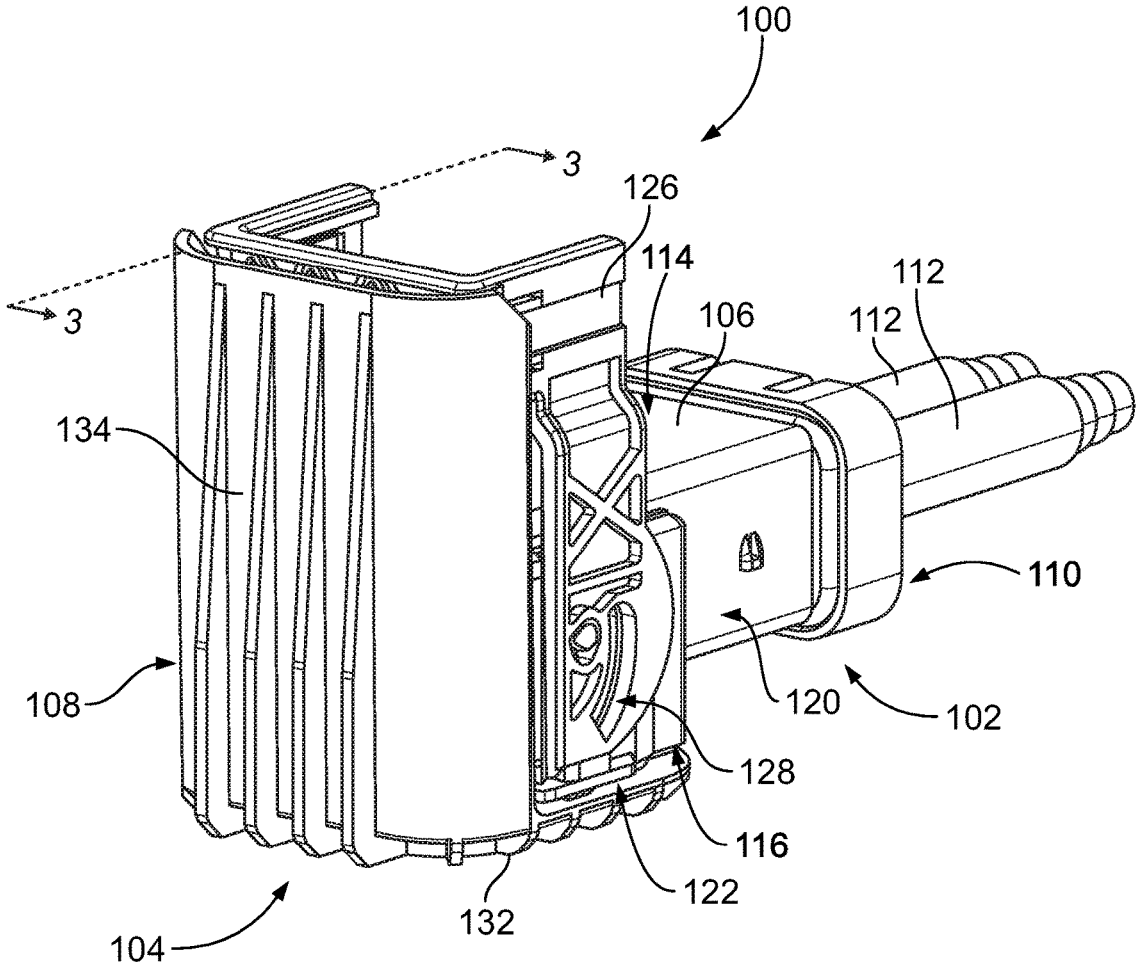
FIG. 1 is a top perspective view of a connector assembly according to an embodiment.

FIG. 1 is a top perspective view of a connector assembly 100 according to an embodiment. The connector assembly 100 includes an electrical connector 102 and a shipping cap 104. The electrical connector 102 includes a housing 106 that extends between a front end 108 and an opposite rear end 110. The electrical connector 102 is mounted to one or more cables 112 or wires, which extend from the rear end 110. The cables 112 may be components of a wire harness.

The housing 106 includes a top side 114, a bottom side 116, a left side 118 (shown in FIG. 2), and a right side 120 extending between the front and rear ends 108, 110. As used herein, relative or spatial terms such as "top," "bottom," "front," "rear," "left," and "right" are only used to distinguish the referenced elements in the connector assembly 100 and do not necessarily require particular positions or orientations in the surrounding environment of the connector assembly 100. In the illustrated embodiment, the electrical connector 102 defines a mating end 122 along the bottom side 116 of the housing 106. The mating end 122 is configured to interface with a mating connector (not shown) during a mating operation. For example, the mating end 122 defines a mating opening 124 (shown in FIG. 2) that is configured to receive (at least a portion of) the mating connector therein. Although not shown, the electrical connector 102 may include one or more electrical contacts within the housing 106 that are configured to engage and establish conductive connections with corresponding electrical contacts of the mating connector that are received in the housing 106 through the mating opening 124.

The electrical connector 102 further includes a lever 126 that is coupled to the housing 106 and is pivotable relative to the housing 106. The lever 126 is configured to support the mating operation, such as by providing leverage to reduce the amount of manual effort required to pull the electrical connector 102 towards the mating connector to achieve a fully mated position. The lever 126 may also support the mating operation by providing a mechanism for locking the electrical connector 102 in the fully mated position relative to the mating connector. The lever 126 is pivotable relative to the housing 106 between an open position and a closed position. In an embodiment, during the start of a mating operation, the lever 126 is placed in the open position in order to receive a guide journal or post (not shown) of the mating connector in a guideway 128 of the lever 126. Rotation of the lever 126 from the open position to the closed position is configured to pull the guide journal linearly to pull the mating connector into the mating opening 124 (and/or vice-versa such that the electrical connector 102 is pulled towards the mating connector). The electrical connector 102 reaches the fully mated position upon the lever 126 attaining the closed position. The electrical connector 102 optionally is not fully mated to the mating connector when the lever 126 is not in the closed position.

The shipping cap 104 is removably mounted to the housing 106 of the electrical connector 102. The shipping cap 104 is configured to be mounted to the connector 102 during shipping and/or installation of the connector 102, and is configured to be removed from the connector 102 prior to mating the connector 102 with the mating connector. The shipping cap 104, when mounted on the connector 102, is configured to block debris and contaminants from entering the housing 106 through the mating opening 124 (shown in FIG. 2). The shipping cap 104 is also configured to control the positioning of the lever 126 relative to the housing 106, such that as the shipping cap 104 is removed from the connector 102, the lever 126 is automatically located in the open position. Therefore, after routing the connector assembly 100 around various devices and/or components, such as in an automobile, to reach the mating connector, a worker installing the electrical connector 102 on the mating connector does not have to manually position the lever 126 in the open position. In some known connectors, a lever may be pre-positioned in an open position, but the shipping and/or routing of the connector may dislodge the lever from the open position, requiring the worker to reset the lever prior to mating. In the embodiments of the connector assembly 100 described herein, the lever 126 is automatically set to the open location when the shipping cap 104 is removed to make the installation process more efficient.

In an embodiment, the shipping cap 104 includes a lid 132 that covers the mating opening 124 (shown in FIG. 2) of the electrical connector 102 to seal the opening 124 against the transfer of debris (e.g., dust, dirt, sand, etc.) and contaminants (e.g., oil, water, chemicals, etc.) into the housing 106. The shipping cap 104 in the illustrated embodiment further includes a shield 134 that extends from the lid 132 in front of the front end 108 of the electrical connector 102. The shield 134 is configured to block foreign objects from contacting the lever 126, such as while routing the connector assembly 100, to prohibit the lever 126 from being dislodged from the open position. Thus, as the connector assembly 100 is moved in a forward direction, a foreign object may abut against the shield 134 that is in front of the lever 126 without engaging the lever 126.

Figure 2:
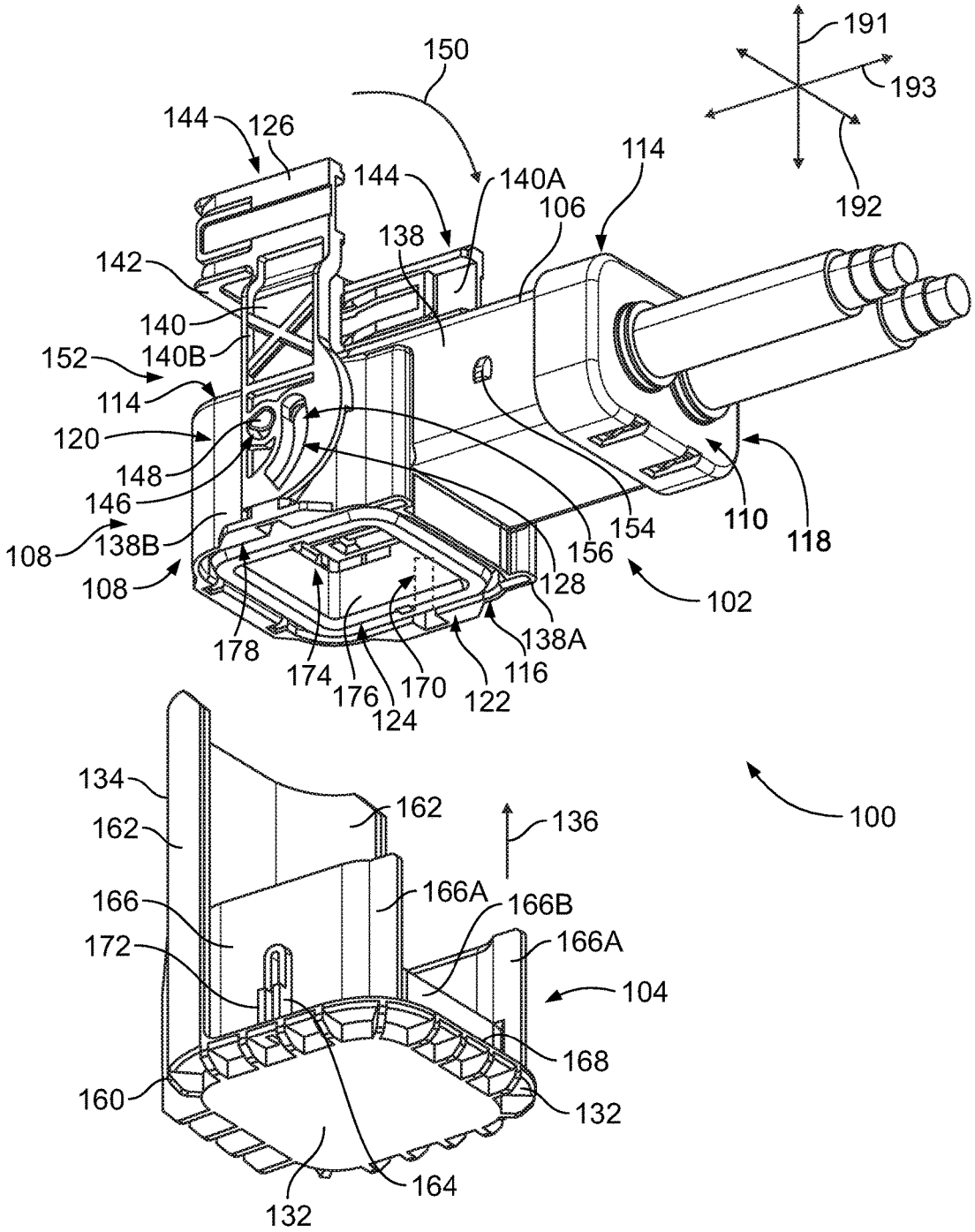
FIG. 2 is a bottom perspective view of the connector assembly of FIG. 1 in an exploded state showing a shipping cap spaced apart from an electrical connector.

FIG. 2 is a bottom perspective view of the connector assembly 100 of FIG. 1 in an exploded state showing the shipping cap 104 spaced apart from the electrical connector 102. The shipping cap 104 is shown poised for mounting to the electrical connector 102. The exploded connector assembly 100 is oriented with respect to a vertical or elevation axis 191, a lateral axis 192, and a longitudinal axis 193. The axes 191-193 are mutually perpendicular. Although the vertical axis 191 appears to extend generally parallel to gravity, it is understood that the axes 191-193 are not required to have any particular orientation with respect to gravity. The shipping cap 104 is mounted to the connector 102 by moving the shipping cap 104 relative to the connector 102 in a loading direction 136 along the vertical axis 191.

Figure 5:
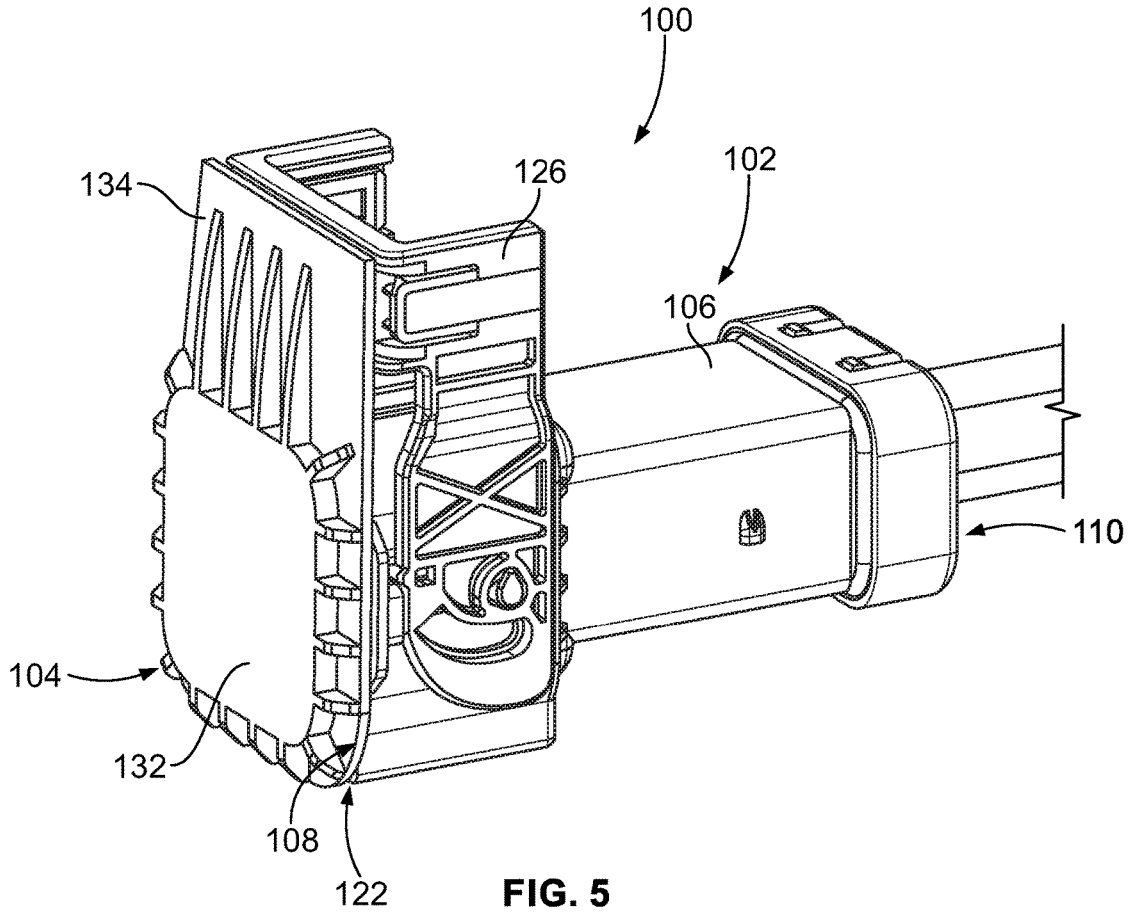
FIG. 5 is a top perspective view of the connector assembly according to an alternative embodiment.

In the illustrated embodiment, the mating end 122 of the connector 102 is along the bottom side 116 of the housing 106. The mating end 122 is oriented in a plane defined by the lateral and longitudinal axes 192, 193. The rear end 110 of the housing 106 is oriented along a plane defined by the vertical and lateral axes 191, 192. Since the rear end 110 is oriented perpendicular to the orientation of the mating end 122, the electrical connector 102 is a right angle connector. Although the rear end 110 is described as being perpendicular to the mating end 122, the angle between the orientations of the rear end 110 and the mating end 122 optionally may not be a right angle. In an alternative embodiment, the electrical connector 102 may be an inline connector such that the mating end 122 and rear end 110 are oriented parallel to one another, as shown in FIG. 5.

The electrical connector 102 has side walls 138 along the left and right sides 118, 120 of the housing 106. The lever 126 is coupled to the side walls 138. For example, the lever 126 has a generally U-shaped structure that includes two arms 140 and a handle 142 that extends between and connects the two arms 140 at distal ends 144 of the arms 140. The arms 140 are pivotally coupled to the side walls 138 such that a first arm 140A is coupled to a left side wall 138A and a second arm 140B is coupled to a right side wall 138B. The arms 140 each define an aperture 146 that receives a corresponding axle 148 of the housing 106 therein. The axles 148 extend laterally outward from the side walls 138. The axles 148 retain the lever 126 on the housing 106. The lever 126 pivots about the axles 148. In an alternative embodiment, the lever 126 includes axles received in corresponding apertures of the housing 106.

The lever 126 is shown in the open position. In the illustrated embodiment, the lever 126 is oriented such that the arms 140 extend generally vertically along the vertical axis 191. The handle 142 is disposed above the top side 114 of the housing 106 and is spaced apart from the top side 114 by a clearance gap 152. The lever 126 is pivoted or rotated about the axles 148 to the closed position by moving the handle 142 in a curved trajectory 150 that is generally rearward and downward towards the top side 114 of the housing 106. The housing 106 also include a locking tab 154 on at least one of the side walls 138 located longitudinally between the axle 148 and the rear end 110. The locking tab 154 includes a catch or a latch that is configured to engage a complementary latch or catch on the lever 126 when the lever 126 reaches the closed position in order to lock the lever 126 in the closed position. Thus, the locking tab 154 engages the lever 126 when the lever 126 is in the closed position to restrict the ability of the lever 126 to pivot towards the open position.

The guideway 128 of the lever 126 is located proximate to the aperture 146. The guideway 128 includes a cam slot 156 and an insertion recess 158 (shown in FIG. 3). In an embodiment, the lever 126 includes one guideway 128 on each arm 140. The cam slot 156 has a curved profile. The cam slot 156 extends fully through the arm 140. The insertion recess 158 does not extend fully through the arm 140, such that the insertion recess 158 is not visible in FIG. 2 on the outer side of the arm 140.

The lid 132 of the shipping cap 104 is oriented parallel to the mating end 122 at the bottom side 116 of the housing 106. The lid 132 is configured to cover and seal the mating opening 124 of the housing 106. The shield 134 of the shipping cap 104 extends from a front edge 160 of the lid 132. The shield 134 extends in a direction that is transverse to an orientation of the lid 132 in the illustrated embodiment. Thus, while the lid 132 covers the mating opening 124 at the bottom side 116 of the housing 106 (when mounted to the housing 106), the shield 134 covers the front end 108 of the housing 106. The shield 134 may be at least partially curved, at least along lateral end portions 162 of the shield 134, in order to provide sufficient structural rigidity to the shield 134 to prohibit the shield 134 from being deflected rearward into engagement with the lever 126 if the shield 134 is impacted by a remote object.

The shipping cap 104 further includes a blocking tab 164 that is disposed vertically above the lid 132. The blocking tab 164 is configured to be received in the guideway 128 of the lever 126 when the lever 126 is in the open position and the shipping cap 104 is moved towards the housing 106 to mount the shipping cap 104. As described in more detail below, the blocking tab 164 is configured to engage the lever 126 (for example, walls or edges of the guideway 128) to control the position of the lever 126. For example, the blocking tab 164 in the guideway 128 may block the lever 126 from pivoting from the open position to the closed position. In the illustrated embodiment, the blocking tab 164 is a box-shaped projection (for example, a cuboid or rectangular parallelepiped). Optionally, the box-shaped projection may be embodied as two small box-shaped projections placed adjacent to each other with a small gap therebetween. The box-shaped projection may have other shapes in other embodiments, such as a cylindrical post, a beam, a bulge, or the like.

In an embodiment, the shipping cap 104 includes at least one interior wall 166 extending generally vertically from a top surface 168 of the lid 132. The shipping cap 104 includes multiple interior walls 166 in the illustrated embodiment, including primary walls 166A and a secondary support wall 166B that extends between the primary walls 166A. The interior walls 166 enter the housing 106 through the mating opening 124 as the shipping cap 104 is moved in the loading direction 136. The interior walls 166 may be used to secure the shipping cap 104 to the housing 106, such as via an interference fit with inner surfaces of the housing 106. In the illustrated embodiment, the blocking tab 164 is mounted on one of the primary interior walls 166 and extends outward therefrom. In an embodiment, the shipping cap 104 includes a blocking tab 164 on each of the primary interior walls 166. In an alternative embodiment, the blocking tab 164 may be mounted to the top surface 168 of the lid 132 instead of to an interior wall 166. For example, the shipping cap 104 in an alternative embodiment may not include any interior walls 166.

As the interior walls 166 are received through the mating opening 124 into a cavity 174 of the housing 106, the blocking tab 164, mounted to one of the interior walls 166, at least partially enters the cavity 174. For example, the blocking tab 164 may extend outward through an access slot 170 defined in a side wall 138 of the housing 106. Therefore, an outer portion 172 of the blocking tab 164 is located outside of the cavity 174 along an exterior of the side wall 138, and an inner portion of the blocking tab 164 more proximate to the interior wall 166 is located inside the cavity 174. The outer portion 172 of the blocking tab 164 is received in the guideway 128 of the lever 126, as shown in more detail in FIG. 4. In the illustrated embodiment, the housing 106 includes an access slot 170 defined in each of the two side walls 138A, 138B of the housing 106, but the access slot 170 along the right side wall 138B is obscured from view by the lever 126 and the access slot 170 along the left side wall 138A is obscured from view by an inner liner 176 within the cavity 174 of the housing 106. The access slot 170 along the left side wall 138A is shown in phantom in FIG. 2, but is shown in more detail in FIG. 3. In an embodiment, the interior walls 166 of the shipping cap 104 are received in radial gaps or crevices 178 between the walls 138 of the housing 106 and the inner liner 176.

The shipping cap 104 optionally may be formed of a dielectric material, such as one or more plastic materials. The shipping cap 104 may be molded as a unitary, one-piece component such that the shield 134 is integral to the lid 132. Alternatively, the shield 134 and the lid 132 are discrete and are secured to one another.

Figure 3:
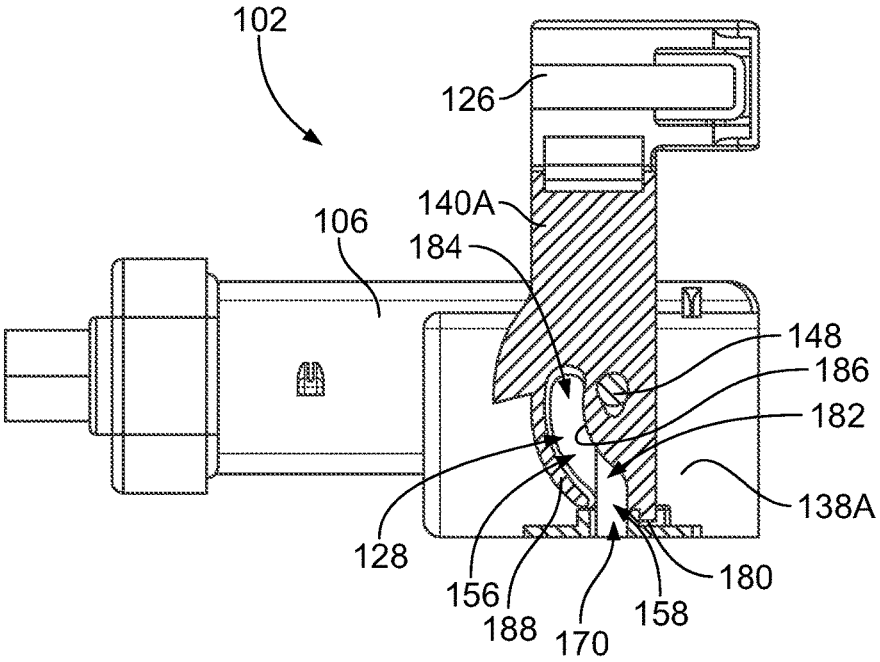
FIG. 3 is a cross-sectional side view of the electrical connector taken along line 3-3 shown in FIG. 1.

FIG. 3 is a cross-sectional side view of the electrical connector 102 taken along line 3-3 shown in FIG. 1. The shipping cap 104 (shown in FIG. 2) is not shown in FIG. 3. The lever 126 is in the open position ready to receive the blocking tab 164 (shown in FIG. 2) of the shipping cap 104 or the guide journal of a mating connector in the guideway 128. The cross-section extends through the left arm 140A of the lever 126, showing a profile of the guideway 128. The guideway 128 includes the cam slot 156 and the insertion recess 158. The insertion recess 158 is open to the cam slot 156 and is located between the cam slot 156 and a perimeter edge 180 of the arm 140A. The insertion recess 158 provides a channel between the cam slot 156 and the perimeter edge 180 such that the guide journal, for example, enters the cam slot 156 through the insertion recess 158. When the lever 126 is in the open position, the insertion recess 158 aligns with the access slot 170 defined in the left side wall 138A of the housing 106.

The cam slot 156 forms a curved path from an entry region 182 adjacent to the insertion recess 158 to an end region 184. The cam slot 156 is defined between first and second runners 186, 188 that each extend along the length of the cam slot 156 between the entry and end regions 182, 184. The runners 186, 188 are curved surfaces or ledges along which the guide journal of the mating connector and/or the blocking tab 164 of the shipping cap 104 can slide. The end region 184 of the cam slot 156 is located more proximate to the axle 148 than the proximity of the entry region 182 to the axle 148. Therefore, when the guide journal of the mating connector is within the cam slot 156, rotation of the lever 126 from the open position to the closed position pulls the guide journal upwards towards the axle 148.

Figure 4:
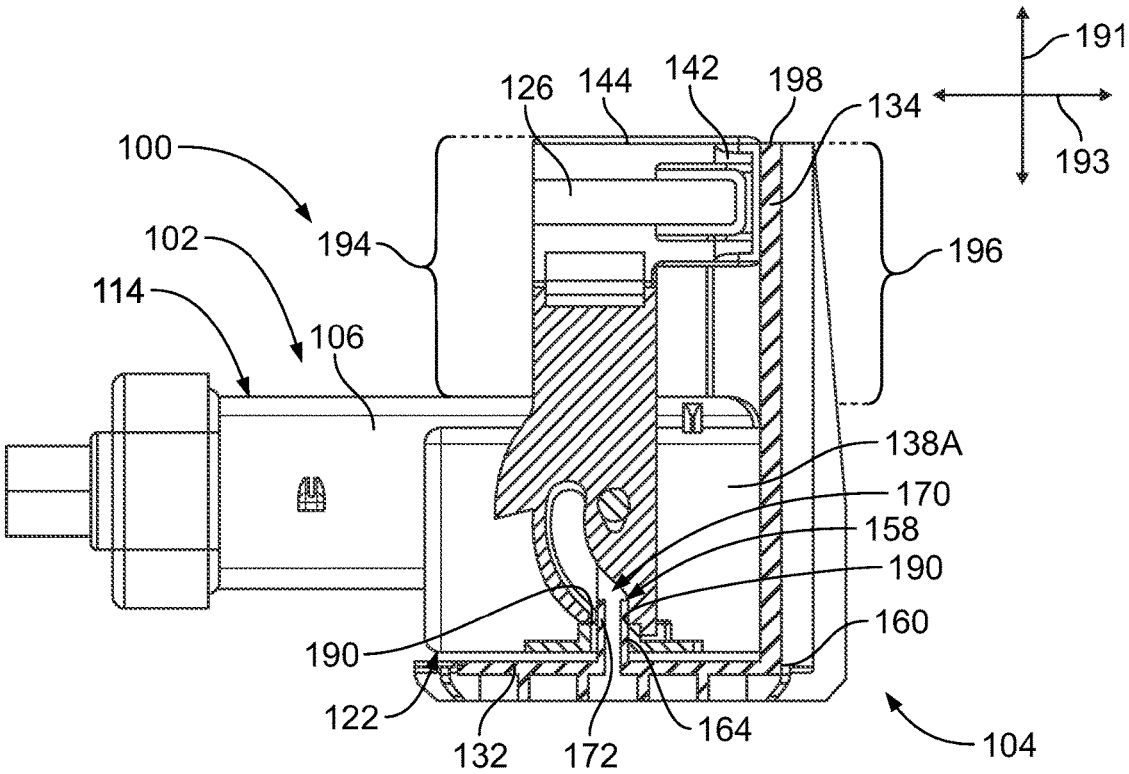
FIG. 4 is a cross-sectional side view of the connector assembly taken along line 3-3 shown in FIG. 1.

FIG. 4 is a cross-sectional side view of the connector assembly 100 taken along line 3-3 shown in FIG. 1. The shipping cap 104 is mounted to the electrical connector 102 in FIG. 4. For example, the lid 132 abuts against the mating end 122 of the housing 106 to seal the mating opening 124 (shown in FIG. 2). The blocking tab 164 of the shipping cap 104 protrudes outward through the access slot 170 of the left side wall 138A. The outer portion 172 of the blocking tab 164 is received within the insertion recess 158 of the lever 126 exterior to the side wall 138A. Since the insertion recess 158 aligns with the access slot 170 when the lever 126 is in the open position, the blocking tab 164 protruding through the access slot 170 aligns with and is received within the insertion recess 158. In an embodiment, the blocking tab 164 engages guide walls 190 of the insertion recess 158 to retain the lever 126 in the open position when the shipping cap 104 is mounted to the connector 102. For example, the blocking tab 164 has a width along the longitudinal axis 193 that is only slightly smaller than a width of the insertion recess 158 between opposing guide walls 190. Therefore, rotation of the lever 126 causes a corresponding guide wall 190 to abut a corresponding side of the blocking tab 164. The shipping cap 104 is configured to be securely mounted to the housing 106, such that the blocking tab 164 is secured in place. Thus, the blocking tab 164 in the insertion recess 158 restricts the lever 126 from pivoting towards the closed position. Therefore, even if the lever 126 is knocked during shipping or routing of the connector 102, the blocking tab 164 retains the lever 126 in the open position. Although only the left side of the connector 102 is shown in FIG. 4, the connector 102 may be symmetrical such that the blocking tab 164 on the right side (shown in FIG. 2) is received in a corresponding insertion recess of the right arm 140B (FIG. 2) of the lever 126.

As shown in FIG. 4, the shield 134 extends generally transverse to the lid 132. The shield 134 in an embodiment extends in front of and covers at least most, if not all of the lever 126 to shield the lever 126. The handle 142 of the lever 126 in FIG. 4 extends a first height 194 above the top side 114 of the housing 106. The shield 134 extends from the front edge 160 of the lid 132 generally vertically (along the vertical axis 191) and protrudes beyond the top side 114 of the housing 106 by a second height 196 that is at least as high as the first height 194. In FIG. 4, a distal end 198 of the shield 134 aligns with the distal end 144 of the lever 126 such that the second height 196 is approximately equal to the first height 194. However, in an alternative embodiment, the second height 196 may be at least slightly greater than or less than the first height 194.

Although the shipping cap 104 is described in FIGS. 1, 2, and 4 as having a shield 134, the shield 134 may be optional since the blocking tab 164 is configured to retain the lever 126 in the open position.

FIG. 5 is a top perspective view of the connector assembly 100 according to an alternative embodiment. The electrical connector 102 in FIG. 5 is an inline connector instead of a right angle connector as shown in FIGS. 1-4. For example, the mating end 122 of the connector 102 is located at the front end 108 of the housing 106, and the mating end 122 is oriented parallel to the rear end 110 (instead of perpendicular to the rear end 110). The shipping cap 104 in the illustrated embodiment is modified to protect the lever 126. For example, the lid 132 extends along the front end 108 to cover the mating opening (not shown), and the shield 134 extends vertically from the lid 132 to shield the lever 126. The shield 134 is oriented parallel to the lid 132 (instead of transverse as shown in FIG. 4). Besides the differences described above, the embodiment of the connector assembly 100 shown in FIG. 5 functions the same way as the embodiment shown and described with reference to FIGS. 1-4.

Figure 6:
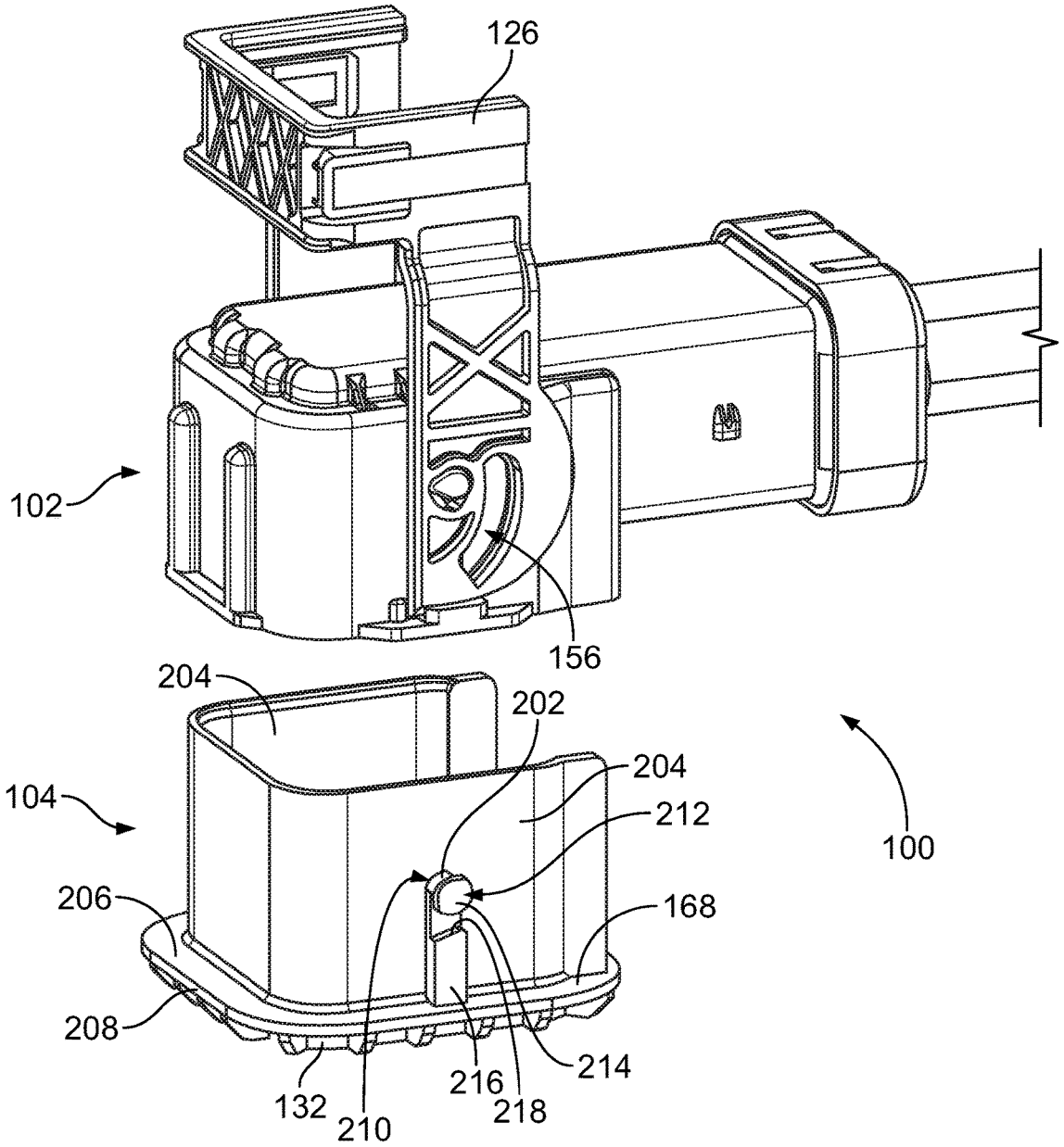
FIG. 6 is a top perspective view of another alternative embodiment of the connector assembly in an exploded state showing the shipping cap spaced apart from the electrical connector.

FIG. 6 is a top perspective view of another alternative embodiment of the connector assembly 100 in an exploded state showing the shipping cap 104 spaced apart from the electrical connector 102. In the illustrated embodiment, the electrical connector 102 is the same as the electrical connector 102 shown in FIGS. 1-4. The shipping cap 104 in the illustrated embodiment includes the lid 132 and a blocking tab 202, but does not include a shield. The shipping cap 104 includes interior walls 204 that extend vertically upward from the top surface 168 of the lid 132. The lid 132 includes a flange 206 that extends radially outward from the interior walls 204 to perimeter edges 208 of the lid 132. The flange 206 may be used to seal the mating opening 124 (shown in FIG. 2) of the connector 102. The blocking tab 202 is located on at least one of the interior walls 204 and extends outward therefrom. In an alternative embodiment, the blocking tab 202 may be mounted to the top surface 168 of the lid 132 and not to the interior wall 204.

In the illustrated embodiment, the blocking tab 202 is a cylindrical lug 202 that is configured to be received in the cam slot 156 of the lever 126, as described below. The cylindrical lug 202 extends from a fixed end 210 at the interior wall 204 to an outer, free end 212. Optionally, the lug 202 may include a hood 214 at the free end 212. The hood 214 has larger diameter than the lug 202 between the hood 214 and the fixed end 210. The hood 214 may be used to retain the lug 202 in the cam slot 156 of the lever 126. The shipping cap 104 optionally also includes a support block 216 that extends between the cylindrical lug 202 and the lid 132. The support block 216 includes a ledge 218 that may engage a portion of the lever 126. Although only one cylindrical lug 202 is shown in FIG. 6, the shipping cap 104 may include another cylindrical lug on an opposite side of the shipping cap 104.

Figure 7:
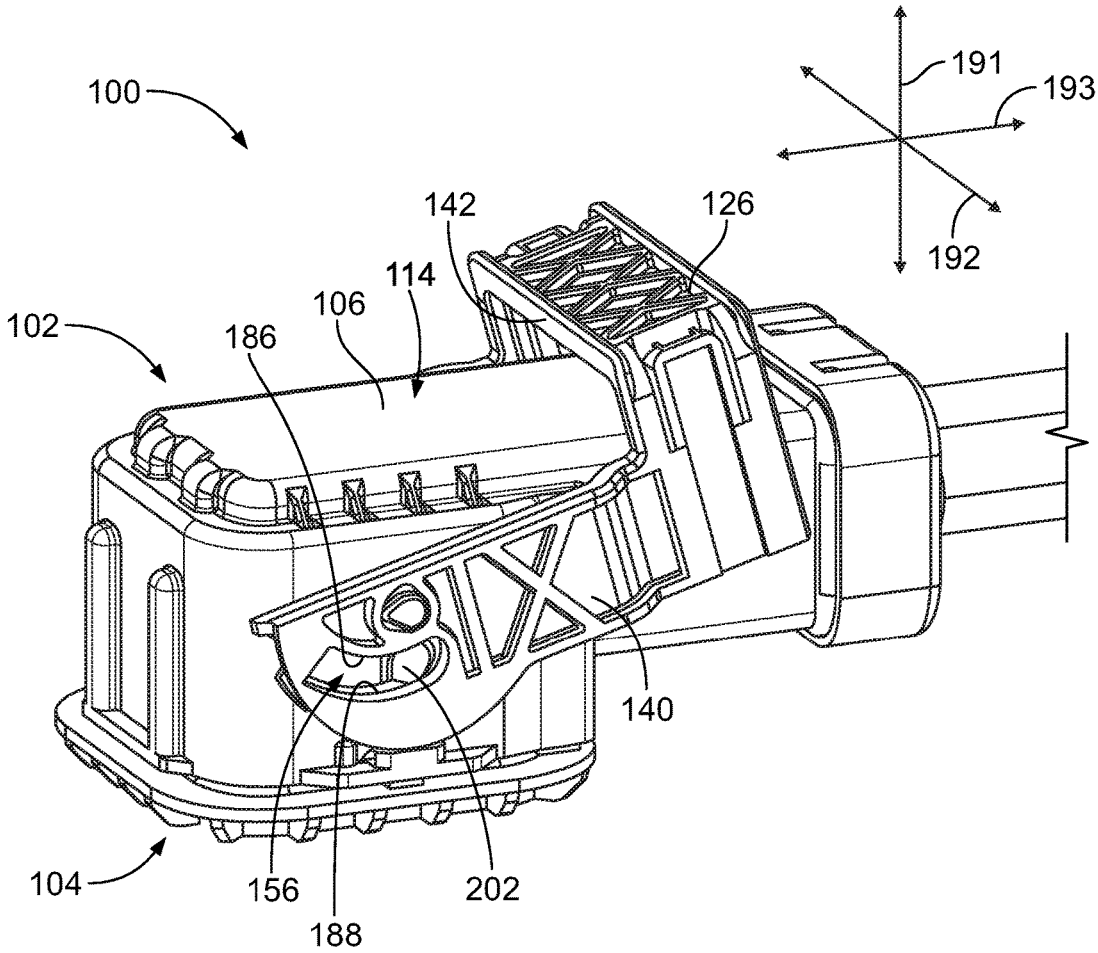
FIG. 7 is a top perspective view of the connector assembly shown in FIG. 6 in an assembled state with the shipping cap mounted to the electrical connector.
Figure 10:
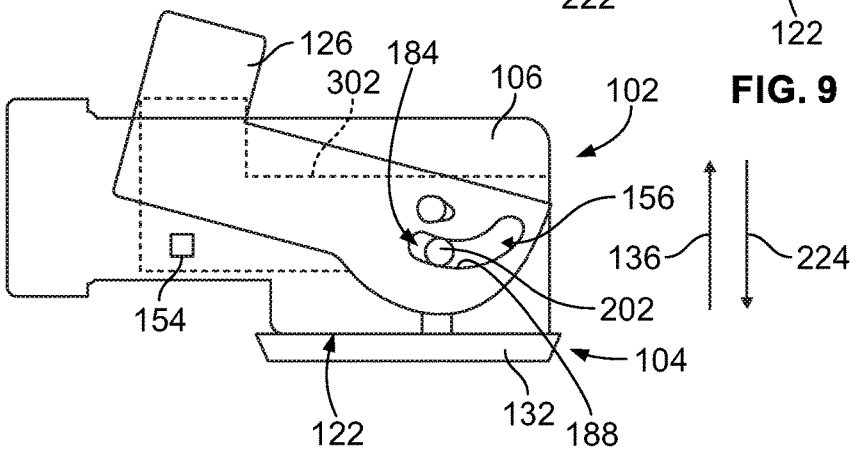
FIG. 10 is a side view of the connector assembly showing the shipping cap at a fully loaded position relative to the electrical connector.

FIG. 7 is a top perspective view of the connector assembly 100 shown in FIG. 6 in an assembled state with the shipping cap 104 mounted to the electrical connector 102. As shown in FIG. 7, the lug 202 of the shipping cap 104 is disposed in the cam slot 156 of the lever 126. In the illustrated embodiment, when the shipping cap 104 is mounted to the connector 102, the lug 202 retains the lever 126 in a partially closed position relative to the housing 106. In the partially closed position, the handle 142 of the lever 126 is spaced apart above the top side 114 of the housing 106 and the arms 140 are angled relative to the longitudinal axis 193 of the connector 102. For a comparison of the partially closed position and the (fully) closed position, FIG. 10 shows the lever 126 in the partially closed position and a phantom outline 302 of the lever 126 in the closed position. The lug 202 in the cam slot 156 is configured to engage at least one of the first and second runners 186, 188 to control the positioning of the lever 126 relative to the housing 106. In an alternative embodiment, the shipping cap 104 may include a shield similar to the shield 134 shown in FIGS. 1 and 2 that is configured to extend in front of the lever 126 to protect the lever 126 from being contacted by foreign objects during shipping and routing.

Figure 8:
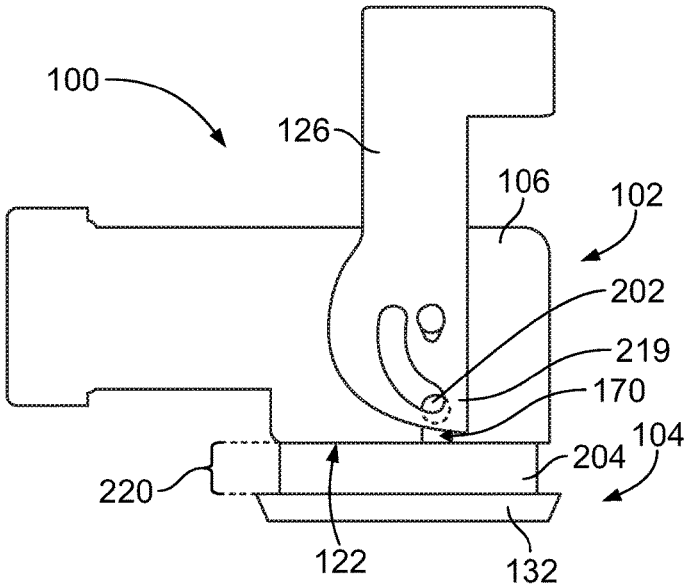
FIG. 8 is a side view of the connector assembly showing the shipping cap at an initial loading position relative to the electrical connector.
Figure 9:
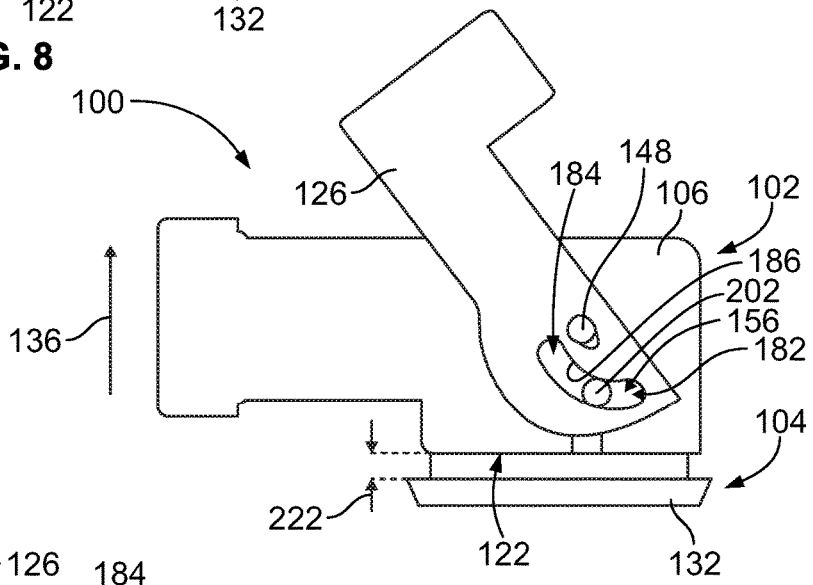
FIG. 9 is a side view of the connector assembly showing the shipping cap at an intermediate loading position relative to the electrical connector.

FIGS. 8-10 are simplified schematic illustrations of the connector assembly 100 shown in FIGS. 6 and 7 at three different times as the shipping cap 104 is mounted to the electrical connector 102. FIG. 8 is a side view of the connector assembly 100 showing the shipping cap 104 at an initial loading position relative to the electrical connector 102. FIG. 9 is a side view of the connector assembly 100 showing the shipping cap 104 at an intermediate loading position relative to the electrical connector 102. FIG. 10 is a side view of the connector assembly 100 showing the shipping cap 104 at a fully loaded position relative to the electrical connector 102.

Referring first to FIG. 8, as the interior walls 204 of the shipping cap 104 are received into the housing 106 through the mating end 122, the cylindrical lug 202 protrudes outward through the access slot 170 and is received in the insertion recess 158 (shown in FIG. 3) of the lever 126. The lever 126 is in the open position to allow the lug 202 to be received in the insertion recess 158. Part of the lug 202 behind an outer surface 219 of the lever 126 is shown in phantom in FIG. 8. The lid 132 is spaced apart from the mating end 122 of the housing 106 by a first distance 220.

Referring now to FIG. 9, as the shipping cap 104 is moved relative to the housing 106 in the loading direction 136, the lug 202 enters the cam slot 156 of the lever 126 (from the insertion recess 158). The lug 202 moves linearly in the loading direction 136 and engages at least the first runner 186. Since the cam slot 156 is curved, the lug 202 slides along the first runner 186 from the entry region 182 towards the end region 184 as the lug 202 moves in the loading direction 136, which causes the lever 126 to pivot about the axle 148 towards the closed position. The lid 132 is spaced apart from the mating end 122 by a second distance 222 that is less than the first distance 220.

Referring now to FIG. 10, when the shipping cap 104 reaches the fully loaded position relative to the housing 106, the lid 132 abuts against the mating end 122 such that the lid 132 is not spaced apart from the mating end 122. The engagement between the lid 132 and the mating end 122 blocks further movement of the shipping cap 104 relative to the housing 106 in the loading direction 136. In an embodiment, the lever 126 does not reach the closed position when the shipping cap 104 is in the fully loaded position. Furthermore, the lug 202 does not reach the end region 184 of the cam slot 156. The lever 126 remains in a partially closed position that is between the open position and the closed position. The position of the lever 126 in the closed position is shown in a phantom outline 302. The lever 126 in the partially closed position may be more proximate to the closed position than the open position. Since the lever 126 is not in the closed position when the shipping cap 104 is fully loaded in the housing 106, the lever 126 does not latch to the locking tab 154. FIGS. 8-10 illustrate that mounting the shipping cap 104 causes the lever 126 to automatically pivot towards the closed position but does not lock the lever 126 in the closed position.

When the electrical connector 102 is in position to be mated to a mating connector after shipping and routing, the shipping cap 104 is removed from the connector 102 in an unloading direction 224 that is opposite to the loading direction 136 in order to expose the mating end 122 for receiving the mating connector. In an embodiment, as the shipping cap 104 is moved in the unloading direction 224 relative to the housing 106, the lug 202 causes the lever 126 to pivot from the partially closed position to the open position such that the lever 126 is automatically set in the open position when the shipping cap 104 disengages the connector 102. For example, the lug 202 moving vertically downwards in the unloading direction 224 may slide along at least the second runner 188 of the cam slot 156 to cause the lever 126 to pivot towards the open position. Therefore, removing the shipping cap 104 causes the lever 126 to pivot from the partially closed position shown in FIG. 10 to the open position shown in FIG. 8. As a result, a worker that mates the electrical connector 102 to the mating connector does not have to reposition the lever 126 prior to the mating operation.

Figure 11:
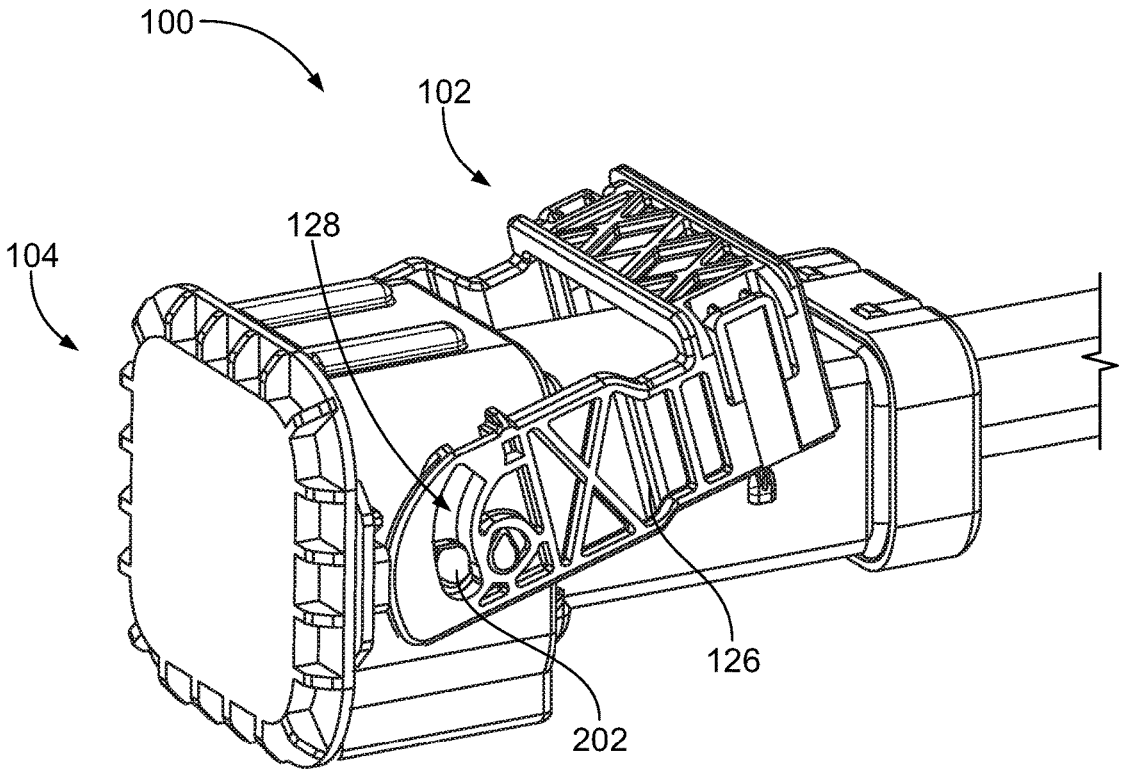
FIG. 11 is a top perspective view of the connector assembly according to another alternative embodiment.

FIG. 11 is a top perspective view of the connector assembly 100 according to another alternative embodiment. The electrical connector 102 in FIG. 11 is the inline connector 102 that is shown in FIG. 5. The shipping cap 104 in the illustrated embodiment is the shipping cap 104 shown in FIGS. 6-10. Thus, the shipping cap 104 shown and described with reference to FIGS. 6-10 may be used interchangeably with right angle connectors and inline connectors without modification. Although the guideway 128 of the lever 126 is oriented differently than the guideway 128 of the right angle connector 102 shown in FIGS. 6-10, the interactions between the lug 202 and the lever 126 are essentially the same as the embodiment shown and described with reference to FIGS. 6-10.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A connector assembly comprising:

an electrical connector including a housing and a lever pivotably coupled to the housing, the housing having a mating opening at a mating end of the housing, the lever pivotable relative to the housing between an open position and a closed position, the lever having a guideway configured to receive a guide journal of a mating connector that mates to the electrical connector, and a shipping cap removably mounted to the mating end of the housing when the electrical connector is not mated to the mating connector, the shipping cap including a lid that covers the mating opening of the housing, the shipping cap further including a blocking tab that is received in the guideway of the lever when the lever is in the open position, the blocking tab in the guideway engaging the lever to block the lever from pivoting to the closed position.

2. The connector assembly of claim 1, wherein the lever includes two arms and a handle that extends between and connects distal ends of the two arms, wherein, in the open position of the lever, the handle extends a first height above a top side of the housing and is spaced apart from the top side by a clearance gap, the shipping cap further including a shield that extends from the lid in front of the lever, the shield extending above the top side of the housing at least as high as the first height to shield the lever.

3. The connector assembly of claim 2, wherein the shield extends transverse to the lid.

4. The connector assembly of claim 1, wherein the shipping cap includes an interior wall that extends from the lid and is received within the mating opening of the electrical connector, the blocking tab extending outward from the interior wall, the lid including a flange extending from the interior wall to a perimeter edge of the lid.

5. The connector assembly of claim 1, wherein, when the shipping cap is mounted to the electrical connector, the blocking tab extends from within the mating opening through an access slot defined in a side wall of the housing, an outer portion of the blocking tab being received in the guideway of the lever exterior to the side wall of the housing.

6. The connector assembly of claim 1, wherein the housing includes a rear end from which at least one cable extends, the rear end being oriented perpendicular to an orientation of the mating end such that the electrical connector is a right angle connector.

7. The connector assembly of claim 1, wherein the guideway includes an insertion recess and a curved cam slot, the insertion recess being open at a perimeter edge of the lever and providing a channel between the curved cam slot and the perimeter edge, the blocking tab of the shipping cap disposed in the insertion recess when the shipping cap is mounted to the housing, the blocking tab engaging guide walls of the insertion recess to retain the lever in the open position.

8. The connector assembly of claim 1, wherein the guideway includes an insertion recess and a curved cam slot, the cam slot defined between first and second runners that extend along a length of the cam slot, the blocking tab of the shipping cap disposed in the cam slot when the shipping cap is mounted to the housing, the blocking tab abutting against at least one of the first and second runners to retain the lever in a partially closed position relative to the housing when the shipping cap is mounted to the housing.

9. The connector assembly of claim 8, wherein, as the shipping cap is being mounted to the housing, the blocking tab moves linearly in a loading direction and enters the cam slot via the insertion recess, the blocking tab engaging at least the first runner to pivot the lever from the open position to the partially closed position.

10. The connector assembly of claim 9, wherein the cam slot extends from an entry region adjacent to the insertion recess to an end region, the blocking tab moving in the loading direction sliding along the first runner through the entry region towards the end region of the cam slot, the blocking tab not reaching the end region of the cam slot when the shipping cap is in a fully loaded position relative to the housing.

11. The connector assembly of claim 8, wherein, as the shipping cap is removed from the housing, the blocking tab moves in an unloading direction in the cam slot and engages at least the second runner to pivot the lever from the partially closed position to the open position.

12. The connector assembly of claim 1, wherein the blocking tab is a cylindrical lug.

13. A connector assembly comprising:

an electrical connector including a housing and a lever pivotably coupled to the housing, the housing extending between a front end and a rear end, the housing having a mating opening configured to receive a mating connector therein, the lever pivotable relative to the housing between an open position and a closed position, the lever defining a guideway configured to receive a guide journal of the mating connector, and a shipping cap removably mounted to the housing at the front end when the electrical connector is not mated to the mating connector, the shipping cap including a lid that covers the mating opening of the housing and a shield that extends from the lid along the front end to shield the lever, the shipping cap further including a blocking tab that is received in the guideway of the lever when the lever is in the open position, the blocking tab in the guideway engaging the lever to block the lever from pivoting to the closed position.

14. The connector assembly of claim 13, wherein the lever includes two arms and a handle that extends between and connects distal ends of the two arms, the handle of the lever extending a first height above a top side of the housing when the lever is in the open position, the shield extending above the top side of the housing at least as high as the first height to shield the lever.

15. The connector assembly of claim 13, wherein the guideway includes an insertion recess and a curved cam slot, the insertion recess being open at a perimeter edge of the lever and providing a channel between the curved cam slot and the perimeter edge, the blocking tab of the shipping cap disposed in the insertion recess when the shipping cap is mounted to the housing, the blocking tab engaging guide walls of the insertion recess to retain the lever in the open position.

16. The connector assembly of claim 13, wherein the mating opening of the housing is along a bottom side of the housing, the lid covering the mating opening being oriented parallel to the bottom side, the shield extending from a front edge of the lid in a direction transverse to the lid, the shield covering the front end of the housing.

17. A connector assembly comprising:

an electrical connector including a housing and a lever pivotably coupled to the housing, the housing having a mating opening at a mating end of the housing, the lever pivotable relative to the housing between an open position and a closed position, the lever having a guideway including a curved cam slot defined by first and second runners that extend a length of the cam slot, the cam slot configured to receive a guide journal of a mating connector that mates to the electrical connector, and a shipping cap removably mounted to the mating end of the housing when the electrical connector is not mated to the mating connector, the shipping cap including a lid that covers the mating opening of the housing, the shipping cap further including a lug that is received in the cam slot of the lever when the lever is in the open position, the lug in the cam slot abutting against at least one of the first and second runners to retain the lever in a partially closed position relative to the housing when the shipping cap is mounted to the housing.

18. The connector assembly of claim 17, wherein the housing includes a rear end from which at least one cable extends, the mating end being oriented at least one of perpendicular to an orientation of the rear end or parallel to an orientation of the rear end.

19. The connector assembly of claim 17, wherein the cam slot extends from an entry region to an end region, wherein, as the shipping cap is being mounted to the housing, the lug moves in a loading direction and slides along the first runner from the entry region of the cam slot towards the end region, pivoting the lever from the open position to the partially closed position, the lug not reaching the end region of the cam slot when the shipping cap is in a fully loaded position relative to the housing.

20. The connector assembly of claim 17, wherein the shipping cap includes an interior wall that extends from the lid and is received within the mating opening of the electrical connector, the lug extending outward from the interior wall, the housing defining an access slot in a side wall of the housing that receives the lug therethrough such that an outer portion of the lug is received in the cam slot of the lever exterior to the side wall of the housing.

* * * * *